US005968317A

United States Patent [19]

Gartz et al.

[11] Patent Number: 5,968,317

[45] Date of Patent: Oct. 19, 1999

[54] METHOD FOR ARRANGING WATER CIRCULATION IN A PAPER MILL

[75] Inventors: Rainer Gartz, Kotka; Sakari Kaijaluoto; Antti Suonperä , both of Jyväskylä, all of Finland

[73] Assignee: Valmet Corporation, Helsinki, Finland

[21] Appl. No.: 08/862,590

[22] Filed: May 23, 1997

[30] Foreign Application Priority Data

May 23, 1996 [FI] Finland ..... 962177

[51] Int. Cl.[6] ..... D21F 1/66

[52] U.S. Cl. ..... 162/190; 162/DIG. 8; 210/928

[58] Field of Search ..... 162/37, 38, 40, 162/189, 190, DIG. 8; 210/134, 195.2, 652, 710, 928

[56] References Cited

U.S. PATENT DOCUMENTS

| | | | |
|---|---|---|---|
| 3,627,679 | 12/1971 | Fuller | 162/29 |
| 3,639,206 | 2/1972 | Spruill | 162/29 |
| 5,196,090 | 3/1993 | Corbellii et al. | 162/190 |
| 5,290,454 | 3/1994 | Dorica et al. | 210/710 |
| 5,302,246 | 4/1994 | Nykanen et al. | 162/29 |
| 5,462,641 | 10/1995 | Bergvist et al. | 162/40 |
| 5,514,282 | 5/1996 | Hibbard et al. | 210/652 |
| 5,529,697 | 6/1996 | Braasch et al. | 210/710 |
| 5,558,782 | 9/1996 | Bleakley et al. | 210/712 |
| 5,635,071 | 6/1997 | Al-Samadi | 210/652 |

FOREIGN PATENT DOCUMENTS

| | | |
|---|---|---|
| 281974 | 4/1975 | Finland . |
| 913189 | 7/1991 | Finland . |
| 945830 | 6/1995 | Finland . |
| 1482002 | 9/1974 | United Kingdom . |
| 1482002 | 8/1977 | United Kingdom . |

*Primary Examiner*—Dean T. Nguyen
*Attorney, Agent, or Firm*—Steinberg & Raskin, P.C.

[57] ABSTRACT

A method for arranging water circulation in a paper mill including a pulp manufacturing plant provided with a water circulation system, such as a TMP plant, and a paper machine provided with a water circulation system. In order to reduce the amount of fresh water supplied to the paper mill, a part of the amount of fresh water supplied to the paper mill is substituted for by water or waters cleaned locally from waters contaminated at the paper mill. The concentrate or concentrates obtained from the stages of water cleaning is/are utilized where applicable by arranging the concentrate (s) to flow upstream in relation to the raw-material flow for reuse at the paper mill. By means of these operations, the amount of contaminants circulating in the paper mill is controlled.

17 Claims, 3 Drawing Sheets

METHOD FOR ARRANGING WATER CIRCULATION IN A PAPER MILL

FIELD OF THE INVENTION

The present invention relates to a method for arranging water circulation in a paper mill which comprises a pulp manufacturing plant provided with water circulation systems, such as a TMP plant, and a paper machine provided with water circulation systems.

BACKGROUND OF THE INVENTION

In paper mills, various paper and board grades are produced in a paper machine by draining water out of a mixture of water and wood fibers prepared in a pulp preparation plant. Water is an essential raw material in the production of paper. Besides operating as a binder and carrier agent for the fibrous material which is called a paper web, water is also needed, among other things, for washing, sealing, lubrication, carrying away disturbing materials (contaminants), and for transferring of thermal energy. In different parts of a paper machine, constantly moving fabrics are used, and for example, such fabrics are present in the wire part, in the press section, and in the dryer section. The fabrics in a paper machine are permeable members which form a closed loop (i.e., are endless) and which are typically made of a plastic and/or a metal material or the fabrics may be felts consisting of natural and/or synthetic fibers. The fabric loops are rotated constantly by means of drive rolls or by means of some other equipment. While draining water from the paper web, the fabrics are contaminated by materials which come from the paper web and from the different process waters. In order that the fabrics and the elements in the paper machine, such as rolls, doctors, forming ribs, suction boxes, etc., should operate well, they must be washed constantly by means of water jets, and the wash water must be removed. The wash water from the fabrics is contaminated, but it can, however, be used as circulation water in the paper machine.

In present-day paper mills, an abundance of fresh water is needed for cooling and, after that, among other things, for the above washing requirements in the wire part and in the press section and for dilution in the stock preparation plant. After the wire part and the press section, these waters are passed mainly to mix with fibrous circulation waters. Any excess amount of circulation water is disposed of as waste water. The net amount of fresh water that is needed for the washing jets in a paper machine is of an order of about 10 cubic meters per ton of paper product produced. Thus, from a paper mill, an abundance of warm waste water is obtained, which must be cleaned, for example biologically, and, if necessary, cooled before the cleaning.

Materials that interfere with the operation of the process enter into the process mainly from the stock preparation and from the broke circulation in the paper machine. Unless the process is connected with separate cleaning devices that remove the disturbing materials, the disturbing materials have just two possible routes of removal: either along with the product or along with the waste waters.

Since the amount of disturbing materials produced in the papermaking process per product ton depends mainly on the raw material used and on the product quality, the concentration of the disturbing materials in the water circulations in the process is relatively linearly dependent on the amount of fresh water that is used.

As known in the prior art, the wash jet waters or water flows in a paper machine are collected by means of various basins and troughs and passed into a circulation water system. Besides fresh water, circulation water of the paper machine is also employed as the jet water in the wire part and the press section. The circulation water is usually cleaned by means of filters, whose screen measure is about 150 $\mu$ (corresponding to about 100 mesh). Such a screen measure, however, permits the passage of fine particles and dissolved material. A clear filtrate obtained from such a filtering device still contains finer particles and dissolved material. If this clear filtrate is used for jet nozzles, these impurities may cause blocking of the jet nozzles and their structures with the disturbing materials and contamination of these devices and other equipment in the water system in a paper machine, which results in negative effects in the quality and production of paper. The use of such water as additional substitute for fresh water would risk impairing the operation of the equipment and the production of the paper. Therefore, for more demanding washing of the fabrics and parts of a paper machine, fresh water is used, which is mostly chemically cleaned prior to actual use.

Fresh water is cold, and it must be heated to a considerable extent to the operating temperature that is required in the paper-making process. The temperature of new fresh cold water must be raised, for example, from about 7° C. to about 50° C., and usually it is treated chemically in order to remove humus materials and color, in compliance with the quality requirements, and its use involves high costs of processing. The high cost of cleaning of fresh water and waste water arises from the fact that an abundance of fresh water must be introduced into the process constantly. Fresh water which is used in the jets in a paper machine and which has been treated chemically also increases the concentrations of inorganic materials in the system.

OBJECTS AND SUMMARY OF THE INVENTION

A primary object of the present invention is to lower the consumption of fresh water in a paper mill.

More specifically, it is an object of the present invention to improve the paper-making process from the point of view of burdening of the environment and the requirement of fresh water (i.e., lessening the requirement thereof). In particular, one object is optimal cleaning of the various contaminated waters present in a paper mill by interconnecting different cleaning devices in a novel manner and by using cleaned waters and the concentrates coming from the cleaning devices in an optimal manner in consideration of their degree of purity and their washing potential.

Another object of the invention is to provide novel overall solutions of technology for paper mills, which solutions, at the same time as they reduce the burden on the environment in the form of lower consumption of fresh water and lower quantities of waste water, also provide economies of energy and reduce the consumption of chemicals in the different parts in a paper mill.

In view of achieving the objects stated above and others, in the present invention, in view of reducing the amount of fresh water supplied to the paper mill, the following operations are carried out as a combination:

a) a part of the amount of fresh water supplied to the paper mill is substituted for by a water flow or water flows cleaned locally from waters contaminated at the paper mill, b) the concentrate or concentrates obtained from the above stages of water cleaning is/are utilized where applicable by arranging the concentrate(s) to flow upstream in relation to the raw material flow for reuse at the paper mill, whereby by means of the performance of operations a) and b), the level of the amounts of interfering substances circulating in the paper mill is controlled.

For the purposes of this application, a "flow upstream in relation to the raw-material flow" refers to upstream flow between the different water circulation systems, i.e., to a location in the papermaking process preceding the cleaning stage at which the concentrate is obtained. In the paper mill in accordance with the present invention, different water circulation systems are, for example, water circulation of defibration (in FIG. 1: reference numerals 29, 24, 27 as described below)

water circulation of pressing before bleaching (in FIG. 1: reference numerals 23, 28)

water circulation of a cut press after bleaching (in FIG. 1: reference numerals 17, 21)

short circuit flow in the paper machine (in FIG. 1: reference numerals 30, 38)

water circulation in the paper machine (in FIG. 1: reference numerals 30, 32, 35, 36, 6)

water circulation of fabric wash waters (in FIG. 1: reference numerals 30, 32, 8, 9, 6).

In the present invention, in order to achieve some or all of the objects stated above, cleaning of filtrate and wash waters may be carried out at one point only, or alternatively and preferably at a number of points. Preferable modes of carrying out cleaning of different waters and preferred reuse of these waters are described below.

It has been estimated that the cleaning and evaporation of process waters optimally in a plant integrated in accordance with the present invention lowers the burdening of the environment considerably and is more advantageous compared with the abundant use of fresh water with the resulting high requirement of cleaning.

In a paper mill in accordance with the present invention, the waste waters are more concentrated, and less waste water is passed to the environment. In other words, the water has been utilized better than in conventional prior art paper mills, and less fresh water has been introduced into the system, as a result of which a smaller amount of waste water is produced. In a paper mill in accordance with the invention, the levels of disturbing materials in the different circulations of water can be controlled, i.e., they can be reduced when necessary, or they can be allowed to remain at a higher level where water having a very high purity is not needed. Overall, the washing potential of the waters is utilized better.

In the following, the invention will be described in more detail by means of preferred embodiments of same. However, the invention is not confined to these preferred embodiments.

The trough waters from the wash jets in a paper machine are, on the average, cleaner than the waters of the short cycle flow in a paper machine. In the prior art, all of these wash waters were mixed with fibrous circulation waters after their use, but in a preferred embodiment of the present invention the semi-clean fabric conditioning water coming from the formers and presses is cleaned and used in a novel way. This is enabled because the waters that clean the wires and felts have not been contaminated to the level of contamination of wire water, so that these waters still have a washing potential etc., potential of use, which is utilized in the present invention. In the present invention, this washing potential still possessed by the relatively clean waters is utilized. In the present invention, the waters that are collected selectively in accordance with the place of origin, e.g., the water that cleans the wires and felts is not collected together with the other water flows but instead is collected separately, can also be cleaned more readily.

In respect of the waste waters, in the present invention a so-called sorting based on the place of origin is applied. For example, water from conditioning of fabrics in a paper machine can be collected apart from other water collection systems and taken for useful use. In this manner, the use of chemically pure water can be reduced. It is an advantage of the invention that chemically purified fresh water is not needed in as equally large quantities as in the prior art for jet water in a paper machine. For example, the jet waters can be cleaned by means of cleaning systems of their own so that a paper mill is obtained which requires a smaller amount of fresh water. In a preferred embodiment of the invention, the waters recovered by means of selective and separate collecting of wash waters can be used after cleaning or without cleaning within the limits that are set by the washing potential.

Disturbing materials or contaminants arrive along with the stock, and the papermaking process produces more such materials. These disturbing materials must be washed along with the water out of the water circulation. In the selective water-collecting in accordance with a preferred embodiment of the invention, the water departing from a paper machine is divided into at least two parts, of which one part is cleaner than the other. In such a case, the short cycle in the paper machine can be operated less clean than in the prior art. Paper mills in accordance with the present invention have a possibility to choose the amount of fresh water that is used. In the present invention, the levels of disturbing materials in a paper machine depend on how large a proportion of the waters in fresh water jets is replaced and on the sort of the replacement water used.

In a preferred embodiment of the invention, there is a novel process arrangement in a paper machine for selective collecting and cleaning jet waters directly after washing by means of a novel cleaning combination, in which flotation and micro-filtration and, if necessary, after these stages, membrane filtration and/or evaporation are employed. The membrane technology that is employed herein is mainly nanofiltration, even if ultrafiltration can be used when lower quality requirements are imposed on the jet water.

Certain disturbing agents, which are derived from wood, pigments and chemicals, are considered to be detrimental impurities, such as pitch, colloids, and dissolved organic and inorganic agents, in particular anionic agents. By means of flotation, solid and colloidal substances can be separated efficiently even without chemicals. By means of chemicals, for example absorbents and polymers, anionic agents can be separated selectively.

The clarified fluid obtained from flotation is filtered further by means of microfiltration. Since flotation separates the major part of the solid matter, the flow resistance in microfiltration is reduced to such an extent that it is possible to use a pore size of 10 $\mu$ with a satisfactory hydraulic capacity. Advantageously, after a 10 $\mu$ filter, nanofiltration is employed. The filtrate from the microfilter can be used for circulation water jets, and the permeate from the nanofilter for more demanding jets.

The level of impurities in the circulation waters in a paper machine is lowered by means of combined flotation and microfiltration cleaning systems, and the cleaned water that is obtained can be passed to the jets in the paper machine and/or, as pretreated water, to further cleaning by means of membrane and/or evaporation technologies. The other part can be used for cleaning of fibers in the production of pulp and paper and/or for dilution of papermaking chemicals.

The selectively collected basin and trough waters of a paper machine, which waters contain a smaller amount of dissolved materials than the circulation water of the paper machine, and which have been cleaned from solid matter by means of a combined flotation and microfiltration technique connected in series, constitute a good preliminary stage for membrane and evaporation technologies. This results both in an improved capacity in both technologies and in an improved efficiency of separation of organic and inorganic materials. The usability of membrane technology is improved, because the concentrate from the membrane filtration can be fed to the evaporation feed.

In papermaking, detrimental impurities are separated as evaporation concentrate and passed to further treatment.

In the present invention, circulation water from the pulp defibration can also be passed to flotation and possibly after that to a membrane separation stage, from which the clean water is passed back to reuse, which is, for example, the sorting stage of the pulp plant. The sludges from all flotations are passed into a sludge press and pressed. The filtrate passes through possible additional cleaning to the evaporator.

The waters of the TMP plant are preferably connected upstream in accordance with the following main principles: The white water departing from the paper machine is primarily passed to forward dilution for the cut press, i.e., to a location before the cut press to mix with the material being passed to the cut press, and possible excess water, if any, is passed to forward dilution for the cut press preceding the bleaching, i.e., to a location before the cut press preceding the bleaching to mix with the material being passed to the cut press.

The concentrate from the membrane separation in the paper machine is passed to forward dilution for the cut press preceding the bleaching, i.e., to a location before the cut press preceding the bleaching to mix with the material being passed to the cut press (or to evaporation, depending on the concentration of the concentrate).

The concentrations of disturbing materials in the TMP plant are controlled by means of the capacity and the separation ability of the flotation and/or membrane separation of the filtrate of the cut press and/or the circulation water of defibration and by means of the amount of clean water passed to the TMP plants.

The required overall quantity of fresh water depends on the permitted levels of disturbing materials in the paper machine and in the TMP plant, as well as on the capacity of the evaporation process that processes the circulation waters.

A basic implementation of the method for arranging water circulation in a paper mill in accordance with the invention, which paper mill includes a pulp manufacturing plant and a paper machine supplied with fresh water and generating contaminated waters, comprises the steps of cleaning at least a portion of the contaminated water generated in the paper mill and generating a relatively clean water filtrate and a concentrate therefrom, and controlling the level of contaminants circulating in the paper mill by substituting a part of fresh water supplied to the paper mill with the filtrate in order to reduce the amount of fresh water being supplied to the paper mill, and directing the concentrate into connection with the pulp at at least one location in the paper mill preceding a location at which the portion of contaminated water generated in the paper mill is cleaned in the direction of flow of the pulp, i.e., upstream in the flow direction of the raw material.

If the pulp manufacturing plant includes pulp bleaching apparatus and a cut press arranged to receive pulp from the pulp bleaching apparatus, at least a portion of white water removed from the paper machine may be directed into connection with the pulp at a location between the pulp bleaching apparatus and the cut press or into the cut press to dilute the bleached pulp. The water cleaning step may entail filtering contaminated water generated by the paper machine, directing water flows coming from wash jets in a wet end of the paper machine into a flotation-microfiltration cleaning stage, separating suspended solids and colloids from the water flows in the flotation-microfiltration stage to clean the water flows, and passing a portion of the cleaned water from the flotation-microfiltration stage together with the filtered contaminated water generated by the paper machine into the wash jets of the paper machine. The cleaning step may also include directing at least a portion of the cleaned water from the flotation-microfiltration stage into and through a membrane filtration stage, and passing the cleaned water from the membrane filtration stage into the flow of pulp in the pulp manufacturing plant. The concentrate generated in the membrane filtering stage may be directed into connection with the pulp at a location between the pulp bleaching apparatus and the cut press or into the cut press to dilute the bleached pulp. In addition to or instead of this concentrate flow, the concentrate generated in the membrane filtering stage may be directed into an evaporator plant in which clean water as a substitute for fresh water is generated from the concentrate, and the clean water generated in the evaporator plant directed into and used in the paper machine.

BRIEF DESCRIPTION OF THE DRAWINGS

Additional objects of the invention will be apparent from the following description of the preferred embodiments thereof taken in conjunction with the accompanying non-limiting drawings, in which.

DETAILED DESCRIPTION OF THE PREFERRED EMBODIMENTS

Figure 1:
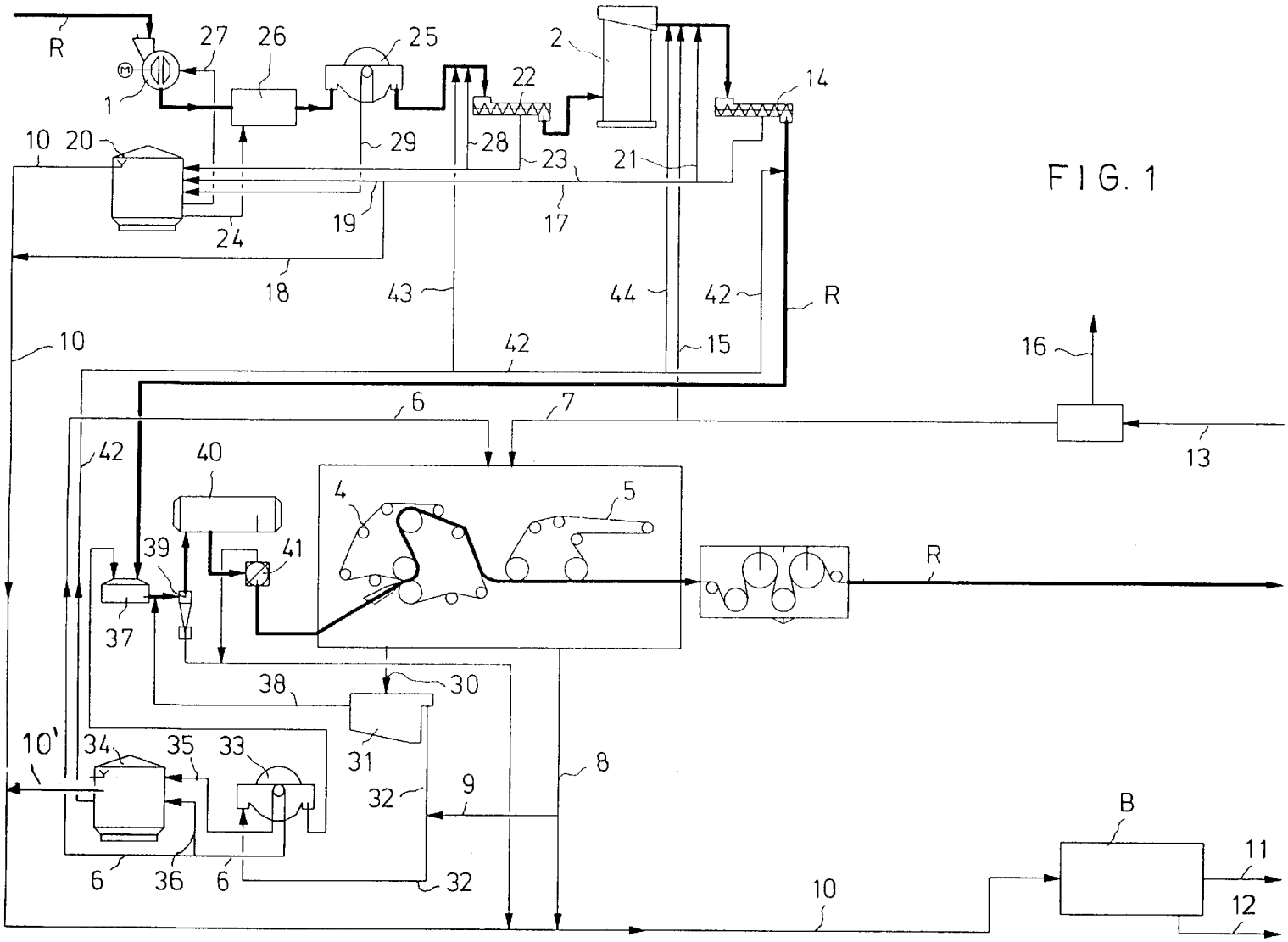
FIG. 1 illustrates a prior art paper mill.
Figure 2:
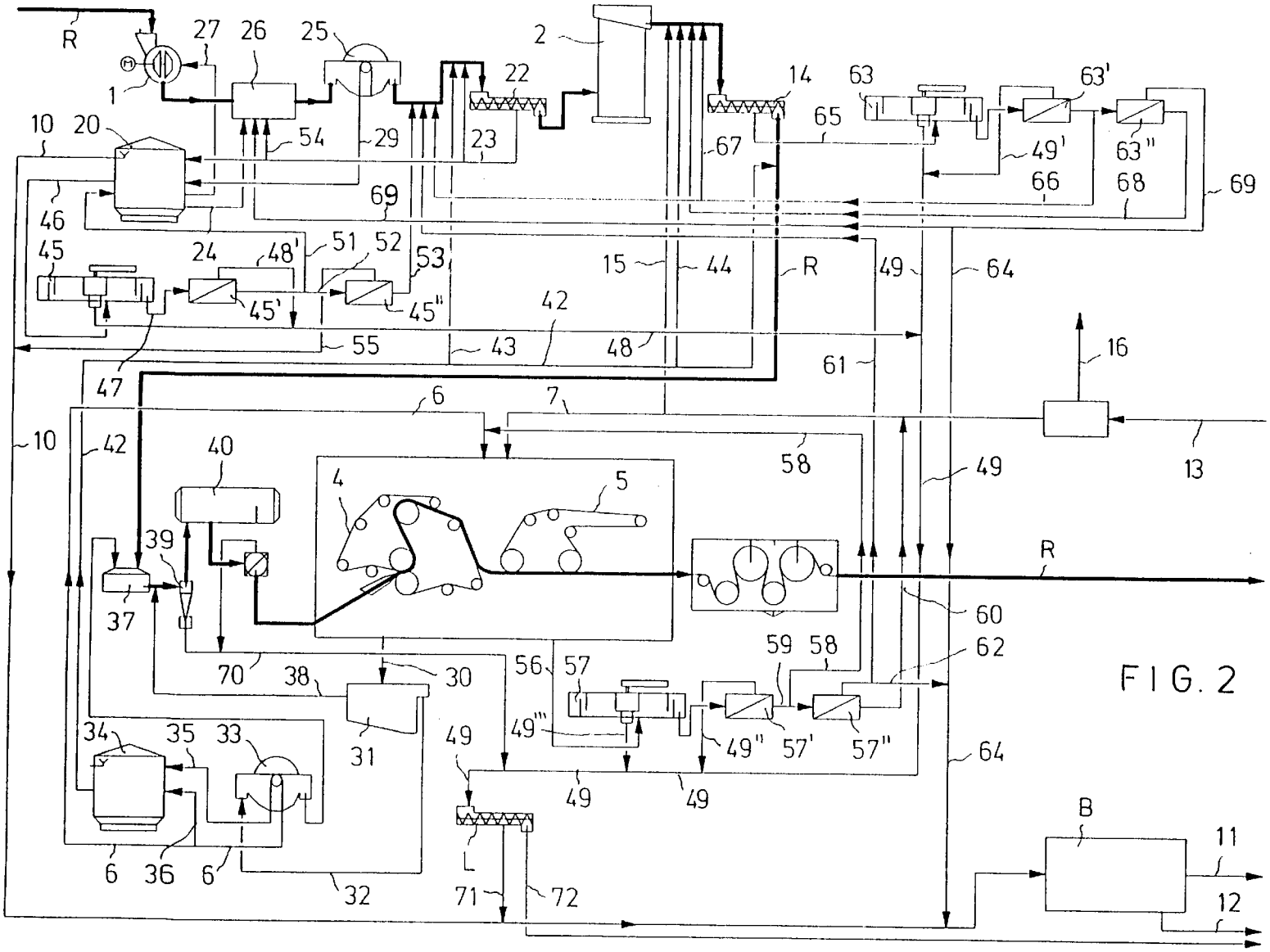
FIG. 2 illustrates a paper mill in accordance with a preferred embodiment of the invention.
Figure 3:
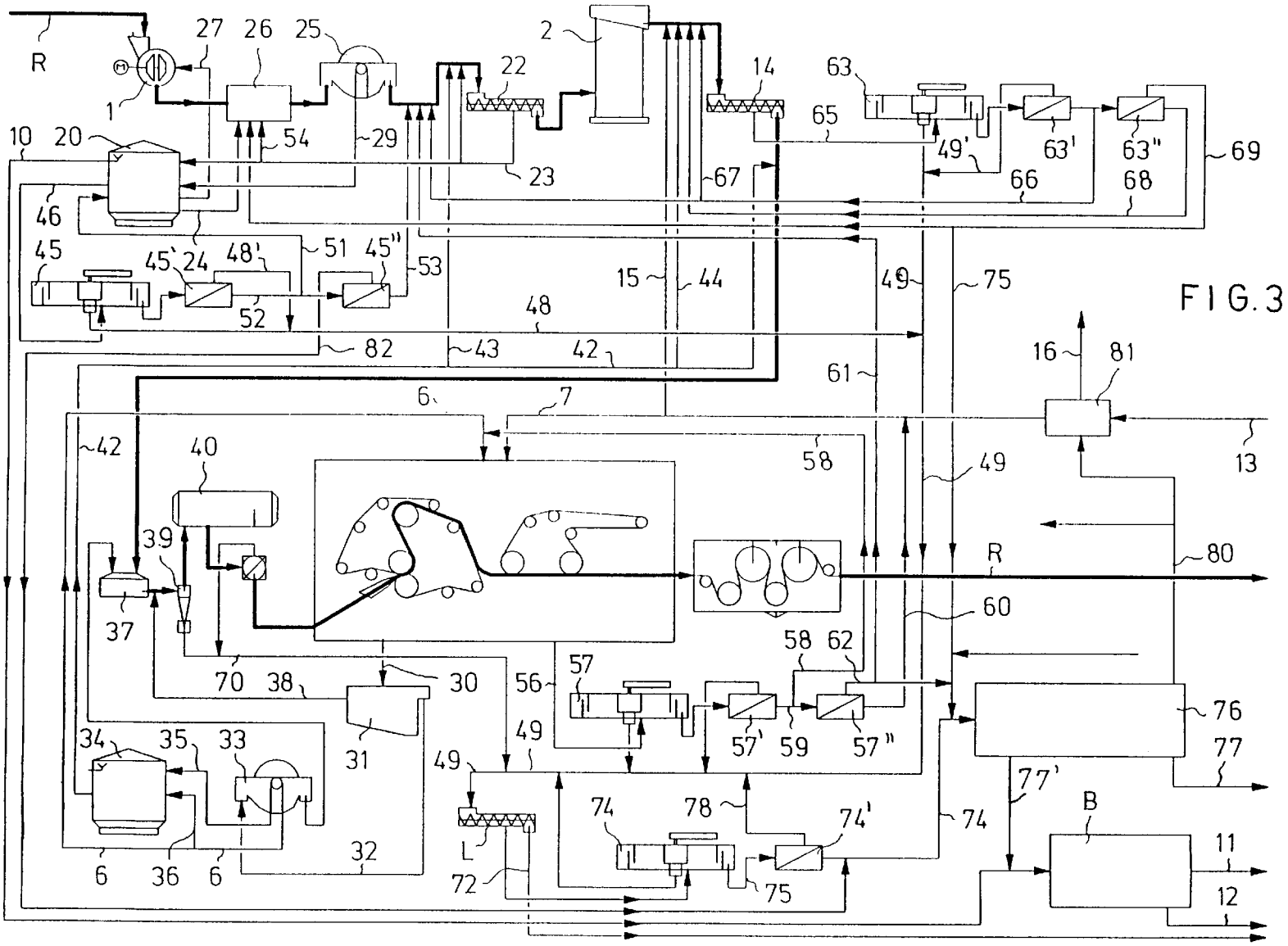
FIG. 3 illustrates a second paper mill in accordance with a preferred embodiment of the invention.

Referring to FIGS. 1–3 wherein like reference numerals refer to the same or similar elements, a prior art paper mill is shown in FIG. 1 and comprises, as a first stage, a pulp preparation plant in which wood raw-material R is passed to mechanical defibration 1 and subsequently through a bleaching plant 2. The run of the raw material is illustrated in the entire mill up to the end with the reference R even though, owing to the processing, it is finally converted to paper. The run of the raw-material is represented in FIG. 1 with the bold line R. After the bleaching plant 2, the bleached pulp R is passed to a paper machine. In the process of FIG. 1, the water circulations of pulp preparation and the paper machine are separated from one another by means of a cut press 14.

From the cut press 14, the water is passed in this prior art paper mill directly to waste water along ducts 17,18, or along a duct 19 into a tank 20 and from tank 20, it is then directed to waste water along a duct 10. Part of the water from the cut press 14 is passed to reuse along a duct 21 to forward dilution for the cut press 14. Water is also passed into the tank 20 from a cut press 22 along a duct 23. From the tank 20, waters are passed along the duct 24 to the pulp preparation plant to the sorting stage 26. From a disk thickener 25, filtrates are passed along a duct 29 also into the tank 20. Further, from the tank 20, circulation water is additionally passed back to the defibration stage 1 along a duct 27. Part of the water coming out from the cut press 22 is passed along a duct 28 again to the forward dilution preceding it.

In the paper machine, the raw material first passes to a wire part 4 and after that to a press section 5 for dewatering. In the wire part 4 and in the press section 5, the wires and the machine parts are cleaned by means of water jets, to which water is passed along ducts 6,7.

In this prior art paper mill, the conditioning and wash waters after performing their function in the wire part 4 or press section 5 are passed into a common wire pit along a duct 8, and from there a minor portion is passed to the sewer for further processing, for example to biological purification B. Mainly, these conditioning waters are combined with circulation waters, which is shown to take place along a duct 9 in FIG. 1. The waste waters from the pulp preparation plant are passed along the duct 10 to processing, e.g., biological treatment B, and further away to the environment along a duct 11, and the sludge generated during the biological treatment B is passed along a duct 12.

Fresh water is introduced into the paper mill along a duct 13 as jet water for the wire part 4 and for the press section 5 along a duct 7, and a small portion is even passed along duct 15 to forward dilution for the cut press 14 following after the bleaching stage. Fresh water may also needed elsewhere, for example, for dilution of chemicals etc., to which uses it is passed in this embodiment along a duct 16.

The circulation water flows (also referred to as the circulation waters) in the wire part 4 pass along a duct 30 into a tank 31 and are passed along a duct 32 to a disk filter 33, and from there, the filtrates pass into a tank 34 along ducts 35 and 36. The cleanest filtrate from the disk filter 33 is used as jet water in the wire part 4, to which it is passed along a duct 6. From the tank 31, dilution water is taken after a stock mixing tank 37 along a duct 38. The raw material runs through the processing stages 37,39,40,41 (stock dilution, screening, rotary cleaning, removal of gases) before the raw material enters into the wire part 4. From the tank 34, part of the waters is passed along a duct 42 to forward dilution for the cut press 22 along a duct 43, to forward dilution for the cut press 14 along a duct 44, or to dilute the stock along a duct 42. From the tank 34, waste waters are also passed along the ducts 10',10 to further treatment, for example biological treatment B, and further away along the duct 11, and the sludge is passed along the duct 12.

Generally speaking, depending on the particular paper mill, the fabric conditioning waters from a paper machine are either passed back into the circulation water system or passed into the sewer. If the fresh-water jets in a paper machine are not sufficient to keep the water circulations in the machine clean enough, additional fresh water can usually be supplied directly into the short cycle in the paper machine.

FIG. 2 illustrates the same process as provided with cleaning parts that remove disturbing materials (contaminants) in accordance with the invention.

The process includes three cleaning devices which separate disturbing materials. The basic process performed in all of the cleaning devices or stages is flotation that removes solid matter and colloids, followed by microfiltration. In all cases, this has still been optionally supplemented with membrane separation that removes soluble substances. The sludges from all flotators and microfilters are passed into a common sludge press L.

In FIG. 2, the desired portion of the waters from the tank 20 are passed to flotation filtration cleaning stage 45 along a duct 46 and further, the filtrated water (the filtrate) is passed from the flotation filtration cleaning stage 45 to microfiltration cleaning stage 45' along a duct 47. An overflow portion of the tank 20 passes along the duct 10 to waste water and is treated, for example, biologically. The sludge from the flotation cleaning stage 45 and from the microfiltration cleaning stage 45' is passed along ducts 48 and 48', which are connected with a duct 49, into the sludge press L. A part of the filtrate from the cleaning stage 45' is passed along a duct 51 to the circulation water tank 20, and another part of the filtrate from the cleaning stage 45' is passed along a duct 52 to membrane separation stage 45". The filtrate from the membrane separation stage 45" is passed along a duct 53 to the forward dilution for the cut press 22. The filtrate from the cut press 22 is distributed as dilution water to a sorting plant 26 along a duct 54 and to forward dilution for the cut press 22. The concentrate from the membrane separation stage 45" is passed to mix with waste waters along a duct 55, which communicates with the duct 10.

The waters coming from the jets in the press section in the wet end of the paper machine are passed along a duct 56 to a flotation/microfiltration cleaning stage 57,57', in which suspended solids and colloids are separated from these waters, and part of the waters thus cleaned are passed to the paper machine as jet waters along a duct 58. Duct 58 is connected to duct 6 so that the jets waters in duct 58 are passed together with the circulation waters from the disk filter 33 along the duct 6 to the jets in the wire part. Another part of the cleaned waters from cleaning stage 57,57' is passed along a duct 59 to membrane filtration stage 57". The filtrate from the membrane separation stage 57" is used, for example, in order to replace fresh water along a duct 60, and its concentrate is passed to forward dilution for the cut press 22 in the pulp preparation plant along a duct 61. This concentrate can also be passed along a duct 62 to waste water. In FIG. 2, the duct 62 joins the duct 64, which again joins the duct 10. The sludges from the cleaning stages 57 and 57' are passed along ducts 49" and 49", which join the duct 49, into the sludge press L.

The concentrations of disturbing materials in the pulp preparation plant are controlled by means of a flotation-microfiltration plant 63,63' placed after the cut press 14 and by means of a possible subsequent membrane separation stage 63", if any. From the cut press 14 placed after the bleaching stage in the pulp preparation plant, the waters are passed along a duct 65 to the cleaning stage, such as the flotation and microfiltration stage 63,63', in which flotation stage the solids and colloids suspended in the water are separated, after which the cleaned water is possibly passed to membrane separation 63", which is preferably carried out by means of an ultrafilter/nanofilter. The filtrate obtained from the cleaning stage 63,63' is passed to the inlet side of the cut press 22 preceding the stock bleaching stage 2 along a duct 66 and to an inlet side of the cut press 14 along a duct 67. The filtrate obtained from the membrane separation 63" is passed back to the inlet side of the cut press 14 placed after the pulp bleaching stage along a duct 68. The sludge from the flotation-microfiltration stage 23,23' are passed along the duct 49', which joins the duct 49, into the sludge press L. The concentrates from the ultrafiltration/nanofiltration stage 63" are passed to a sorting stage 26 in the pulp preparation plant along a duct 69.

The concentrates from the cleaning stages (45,45',45",63, 63',63",57,57',57") in accordance with the invention are passed along the duct 49 into the sludge press L. Also the concentrates from the short circuit are passed along a duct 70, which joins the duct 49, into the sludge press L, from which the filtrate passes to mix with the waste waters along a duct 71 leading into the duct 10, and the sludge is passed away along the duct 72.

In a preferred embodiment of the invention, the filtrate from the sludge press L can be treated by flotation and microfiltration before it is fed into the evaporator. The clean condensate from the evaporator is passed to substitute for fresh water or to some other use, and the contaminated condensate is passed, for example, to a biological cleaning plant. If the capacity of the evaporator is sufficient, other process waters can also be passed into it, for example filtrate from the cleaning device of the water circulation of the TMP plant.

FIG. 3 illustrates a preferred embodiment, which is similar to the embodiment described above with reference to FIG. 2 and which can be considered to be a further development of the embodiment shown in FIG. 2. Circulation waters along the duct 70 and sludges coming from the flotation cleaning 63 and from the microfiltration stage 63' are passed along the ducts 49 and 49' into the sludge press L. The sludge from the cleaning stage 57,57' are also passed into the sludge press L. A difference in this embodiment is that the filtrate from the sludge press L is passed along a duct 73 to a flotation stage 74 and from there along a duct 75 to microfiltration stage 74'.

The concentrate from the microfiltration stage 45" is passed along a duct 82, which joins the duct 79, into an evaporator 76.

After the cleaning stage 63,63', the clean water is passed partly, when desired, to membrane purification 63", from which the concentrate is passed along the duct 69, and further along the duct 75, which joins the duct 79, into the evaporator 76. The concentrate from the evaporator 76 is passed away along the duct 77, and the contaminated condensate is passed along the duct 77' to further cleaning.

The sludge from the microfiltration 74' is passed along the duct 78 and further along the duct 49 back into the sludge press L, and the filtrate from the microfiltration 74' is passed along the duct 79 to the evaporator 76 of the paper mill, and the cleaned water obtained from the evaporator replaces a substantial proportion of the fresh waters introduced into the paper mill, and it is passed along the duct 80 into the fresh water tank 81. The clean water obtained from the evaporator 76 is also passed to other uses along the duct 16. The compressed sludge from the sludge press L is passed along the duct 72 to further treatment.

The examples provided above are not meant to be exclusive and many other variations of the present invention would be obvious to those skilled in the art, and are contemplated to be within the scope of the appended claims.

We claim:

1. A method for arranging water circulation in a paper mill including a pulp manufacturing plant and a paper machine, comprising the steps of:

preparing pulp for the paper machine from wood material in the pulp manufacturing plant, forming a web from the pulp in the paper machine, supplying fresh water to the pulp manufacturing plant and paper machine, generating contaminated water during the pulp preparation step in the pulp manufacturing plant and the web formation step in the paper machine, collecting water contaminated during the pulp preparation step in the pulp manufacturing plant and during the web formation step in the paper machine, cleaning at least a portion of the collected contaminated water and generating a relatively clean water filtrate and a concentrate therefrom, and controlling the level of contaminants circulating in the water circulation loop in the paper mill by substituting a part of fresh water supplied to the water circulation loop in the paper mill with the filtrate in order to reduce the amount of fresh water being supplied to the paper mill, and directing the concentrate into connection with the pulp at at least one location in the pulp manufacturing plant preceding a location at which the portion of contaminated water is cleaned in the direction of flow of the pulp.

2. The method of claim 1, wherein the pulp manufacturing plant includes pulp bleaching apparatus and a cut press arranged to receive pulp from the pulp bleaching apparatus, further comprising the steps of:

removing white water from the paper machine during the formation of the web, and directing at least a portion of the white water removed from the paper machine into connection with the pulp at a location between the pulp bleaching apparatus and the cut press or into the cut press to dilute the bleached pulp.

3. The method of claim 1, wherein said step of cleaning at least a portion of the contaminated water comprises the steps of:

filtering the contaminated water generated during the web formation step in the paper machine during the formation of the web, directing water flows coming from wash jets in a wet end of the paper machine during the formation of the web into a flotation-microfiltration cleaning stage, separating suspended solids and colloids from the water flows in the flotation-microfiltration stage to clean the water flows, and passing a portion of the cleaned water from the flotation-microfiltration stage together with the filtered contaminated water generated during the web formation step in the paper machine into the wash jets of the paper machine.

4. The method of claim 3, wherein said cleaning step further comprises the steps of:

directing at least a portion of the cleaned water from the flotation-microfiltration stage into and through a membrane filtration stage, and passing the cleaned water from the membrane filtration stage into the flow of pulp in the pulp manufacturing plant.

5. The method of claim 4, wherein the pulp manufacturing plant includes pulp bleaching apparatus and a first cut press arranged to receive pulp from the pulp bleaching apparatus, further comprising the step of:

directing concentrate generated in the membrane filtering stage into connection with the pulp at a location between the pulp bleaching apparatus and the first cut press or into the cut press to dilute the bleached pulp.

6. The method of claim 4, further comprising the steps of:

directing concentrate generated in the membrane filtering stage into an evaporator plant in which clean water as a substitute for fresh water is generated from the concentrate, and directing the clean water generated in the evaporator plant into the paper machine.

7. The method of claim 4, further comprises the steps of:

passing sludge generated in the flotation-microfiltration stage and in the membrane filtration stage into a common sludge press, and cleaning filtrate generated by the sludge press by directing the filtrate into and through a flotation/microfiltration device.

8. The method of claim 7, further comprising the steps of:

directing the cleaned filtrate from the flotation/microfiltration device into an evaporator in which clean water as a substitute for fresh water is generated, and directing the clean water generated in the evaporator plant into the paper machine.

9. The method of claim 7, further comprising the steps of:

directing the cleaned filtrate from the flotation/microfiltration device into an evaporator in which clean water as a substitute for fresh water is generated, and directing the clean water generated in the evaporator plant into fresh-water wash jets associated with fabrics in the paper machine.

10. The method of claim 3, further comprising the steps of:

substituting the portion of the cleaned water from the flotation-microfiltration stage for fresh water being supplied to the paper machine, and passing sludge generated in the flotation-microfiltration stage into a sludge press.

11. The method of claim 1, wherein the pulp manufacturing plant includes pulp bleaching apparatus and a first cut press arranged to receive pulp from the pulp bleaching apparatus, wherein said step of cleaning at least a portion of the contaminated water comprises the steps of:

directing water from the first cut press into a flotation-microfiltration cleaning stage, separating suspended solids and colloids from the water flows in the flotation-microfiltration stage to clean the water, and reusing the clean water in the in the paper machine.

12. The method of claim 11, wherein said cleaning step further comprises the steps of:

directing at least a portion of the cleaned water from the flotation-microfiltration stage into and through a membrane filtration stage, and passing the cleaned water from the membrane filtration stage into the flow of pulp in the pulp manufacturing plant.

13. The method of claim 11, wherein the pulp manufacturing plant includes a sorting stage and a second cut press arranged after the sorting stage and before the pulp bleaching apparatus, further comprising the steps of:

directing a portion of the clean water obtained from the flotation-microfiltration stage to an inlet side of the second cut press, directing a portion of the clean water obtained from the flotation-microfiltration stage to an inlet side of the first cut press, and directing concentrates generated in the flotation-microfiltration stage to the sorting stage.

14. The method of claim 1, wherein the pulp manufacturing plant includes a pulp defibration stage, further comprising the steps of:

passing wash water from the pulp defibration stage through at least one cleaning stage such that cleaner water and sludge is generated, reusing the cleaner water in the cleaner water in the paper machine, and passing the sludge from the at least one cleaning stage into a sludge press.

15. The method of claim 14, further comprising the steps of:

directing at least a portion of the cleaned water from the flotation-microfiltration stage into and through a membrane filtration stage, directing concentrate generated in the membrane filtering stage into an evaporator plant in which clean water as a substitute for fresh water is generated from the concentrate, and directing the clean water generated in the evaporator plant into the paper machine.

16. The method of claim 14, wherein the pulp manufacturing plant includes a sorting stage and the step of reusing the cleaner water comprises the step of:

passing the cleaner water from the at least one cleaning stage to the sorting stage.

17. The method of claim 1, further comprising the steps of:

directing contaminated waters generated during the pulp preparation step in the pulp manufacturing plant into an evaporator in which clean water as a substitute for fresh water is generated, and directing the clean water generated in the evaporator plant into fresh-water wash jets associated with fabrics in the paper machine.

* * * * *